US010612244B1

(12) United States Patent
Reichard

(10) Patent No.: US 10,612,244 B1
(45) Date of Patent: Apr. 7, 2020

(54) LANDSCAPING STRUCTURE

(71) Applicant: Patricia Reichard, St. Louis, MO (US)

(72) Inventor: Patricia Reichard, St. Louis, MO (US)

( * ) Notice: Subject to any disclaimer, the term of this patent is extended or adjusted under 35 U.S.C. 154(b) by 0 days.

(21) Appl. No.: 16/383,060

(22) Filed: Apr. 12, 2019

(51) Int. Cl.

| | |
|---|---|
| ***E04F 11/104*** | (2006.01) |
| ***E04F 11/04*** | (2006.01) |
| ***E04F 11/116*** | (2006.01) |
| ***E04F 11/06*** | (2006.01) |
| ***E04F 11/022*** | (2006.01) |
| *E04F 11/02* | (2006.01) |

(52) U.S. Cl.
CPC ..... *E04F 11/1041* (2013.01); *E04F 11/022* (2013.01); *E04F 11/04* (2013.01); *E04F 11/06* (2013.01); *E04F 11/116* (2013.01); *E04F 2011/021* (2013.01); *E04F 2011/0205* (2013.01)

(58) Field of Classification Search
CPC ..... E04F 11/00; E04F 2011/005; E04F 2011/021; E04F 2011/0218; E04F 11/04; E04F 11/06; E04F 11/062; E04F 11/1041; E04F 11/022; E04F 2011/0205; E04F 11/108; E04F 11/112; E04F 11/116
See application file for complete search history.

(56) References Cited

U.S. PATENT DOCUMENTS 1,336,718 A * 4/1920 Barksdale ..... E04F 11/022 52/190
1,533,166 A * 4/1925 Daly ..... B28B 23/02 52/190
1,963,866 A * 6/1934 Peterson ..... E04F 11/022 52/190
2,044,260 A * 6/1936 Schiele ..... E04F 11/022 52/184
2,313,363 A 7/1940 Schmitt
2,221,358 A * 11/1940 Neal ..... E04F 11/022 52/190
3,343,316 A * 9/1967 McIntire ..... E04F 11/116 52/190
3,908,325 A * 9/1975 Kenngott ..... E04F 11/022 52/188
5,031,376 A 7/1991 Bender et al.
5,479,746 A * 1/1996 Mannonen ..... E02D 17/20 52/182
5,549,420 A 8/1996 Nakayama
5,902,074 A 5/1999 Berkley et al.
6,634,145 B1 * 10/2003 Dolph ..... E04F 11/116 249/14
6,854,220 B2 2/2005 Dueck et al.
7,850,402 B1 12/2010 Justiniano
7,918,628 B1 4/2011 Siver et al.
(Continued)

FOREIGN PATENT DOCUMENTS

CA 2270495 A1 * 10/1999 ..... E04F 11/022
FR 2307448 A7 * 11/1976 ..... E04F 11/035
KR 20050008298 A * 1/2005

*Primary Examiner* — Jessie T Fonseca
(74) *Attorney, Agent, or Firm* — Cramer Patent & Design, PLLC; Aaron R. Cramer

(57) ABSTRACT

A landscaping structure incorporates a plurality of metal spikes secured beneath a first plate. A second plate is removably secured to the top surface of the first plate. A cover is removably secured to the top surface of the second plate. The top cover comprises a plurality of materials and physical appearances capable of mimicking a paving stone or similar structure.

20 Claims, 6 Drawing Sheets

(56) References Cited

U.S. PATENT DOCUMENTS

| | | | | |
|---|---|---|---|---|
| 8,522,921 | B2 * | 9/2013 | Stanaland | E04F 11/04 182/196 |
| 8,579,552 | B2 | 11/2013 | Yu | |
| 8,960,368 | B2 * | 2/2015 | Stanaland | E04F 11/04 182/196 |
| 9,267,260 | B2 | 2/2016 | MacDonald et al. | |
| 9,644,376 | B2 * | 5/2017 | Stanaland | E04F 11/04 |
| 2012/0080271 | A1 * | 4/2012 | Stanaland | E04F 11/04 182/196 |

* cited by examiner

LANDSCAPING STRUCTURE

FIELD OF THE INVENTION

The presently disclosed subject matter is directed to a landscaping structure.

BACKGROUND OF THE INVENTION

Flower and vegetable gardens are frequently seen items in any yard from the smallest cottage to the largest mansion. As many of these gardens are arranged on multi-level arrangements, steps are commonly incorporated to make stepping from one level to another a safe activity. These steps are frequently made of large stones, bricks, pavers, large timbers, or even concrete. As such, their placement is typically permanent.

This makes seasonal changes to the garden difficult as walkways, paths, and other walking areas must always remain aligned with the steps. While some items such as large stones and timbers can be pressed into service as steps, they are heavy and difficult to move and yet still are prone to rocking back and forth in an unsteady manner which places one's safety at risk. Accordingly, there exists a need for a means by which garden steps can be easily installed and frequently moved in a manner which addresses the above-mentioned problems. The development of the landscaping structure fulfills this need.

SUMMARY OF THE INVENTION

The principles of the present invention provide for a landscaping step device comprises a decorative step cover which has a decorative outer finish and a pair of long-threaded spikes each of which have a lower end. The lower ends are each provided with a stop nut to allow for adjustment of the landscaping step device to local grade conditions. The device also provides for a ground plate having a pair of angled gripping surfaces, a first front edge, and a second front edge, with each of the pair of angled gripping surfaces are provided on each the lower end of the long-threaded spike and a pair of oblong holes which are symmetrically located along a center axis of the ground plate. The pair of oblong holes are configured to accept the pair of long-threaded spikes. The pair of oblong holes shape accommodates each the long-threaded spike when in an angled position as required by use of the grade adapter.

The device also calls for a set of a pair of first threaded openings provided near the first front edge for connection of the upper end of the long-threaded spike; a set of a pair of second threaded openings provided opposite the first front edge for connection of the upper end of each of the short-threaded spike; a set of four inlay grab connectors penetrating through the entire surface of the step plate which are provided for a connection of the decorative step cover and a recessed area centrally and symmetrically located for receiving the step plate. The recessed area prohibits vision of the step plate and presents an aesthetically pleasing view of the landscaping step device when approaching at an upward angle.

The device also calls for a set of four hook latches which are located along the associated side edges which engage the inlay grab connector to prevent uplift and ensure structural rigidity of the landscaping step device to penetrate through the entire surface of the step plate while also providing for a connection to the decorative step cover. The device also provides a step plate below the step cover. The step plate interconnects the decorative step cover to the pair of long-threaded spikes and a pair of short-threaded spikes.

The decorative step cover may be made of material selected from the group consisting of polystyrene, fiberglass, or durable, weatherproof, lightweight material reinforced with a metal core and may be three feet wide, two feet deep, and six inches tall. The decorative outer finish is selected from the group consisting of brickwork, flagstone, or wood planks. Each stop nut may be rotated on each the long-threaded spike until a desired level of the step plate is reached. A washer may be provided to reinforce the stop nut while a grade adapter may be installed immediately below the washer. The grade adapter may include a top surface that is generally flat and level when in its final installed state and a bottom surface that generally matches the grade angle of the inclining elevation producing an incline angle. The grade adapter may produce the incline angle in five-degree increments with the landscaping step device.

The pair of angled gripping surfaces may run along an entire length of both the edges of the ground plate while the recessed area is hidden by an outer protruding face of the decorative step cover which is covered with the decorative outer finish on both the upper surface and the side surface. The recessed area is centrally located within the decorative step cover to provide strength and rigidity. Each pair of short-threaded spikes may include a pointed end to aid in insertion. While the step plate, the long-threaded spike, the short-threaded spike, the stop nut, the washer, the grade adapter, and the ground plate may be made of steel with an anti-corrosion finish. The anti-corrosion finish may be paint or plated while the step plate may be made of material selected from the group of stainless steel, fiberglass, or plastic. The landscaping step device may provide a step to aid in ascending on an outdoor pathway and or a step to aid in descending on the outdoor pathway.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
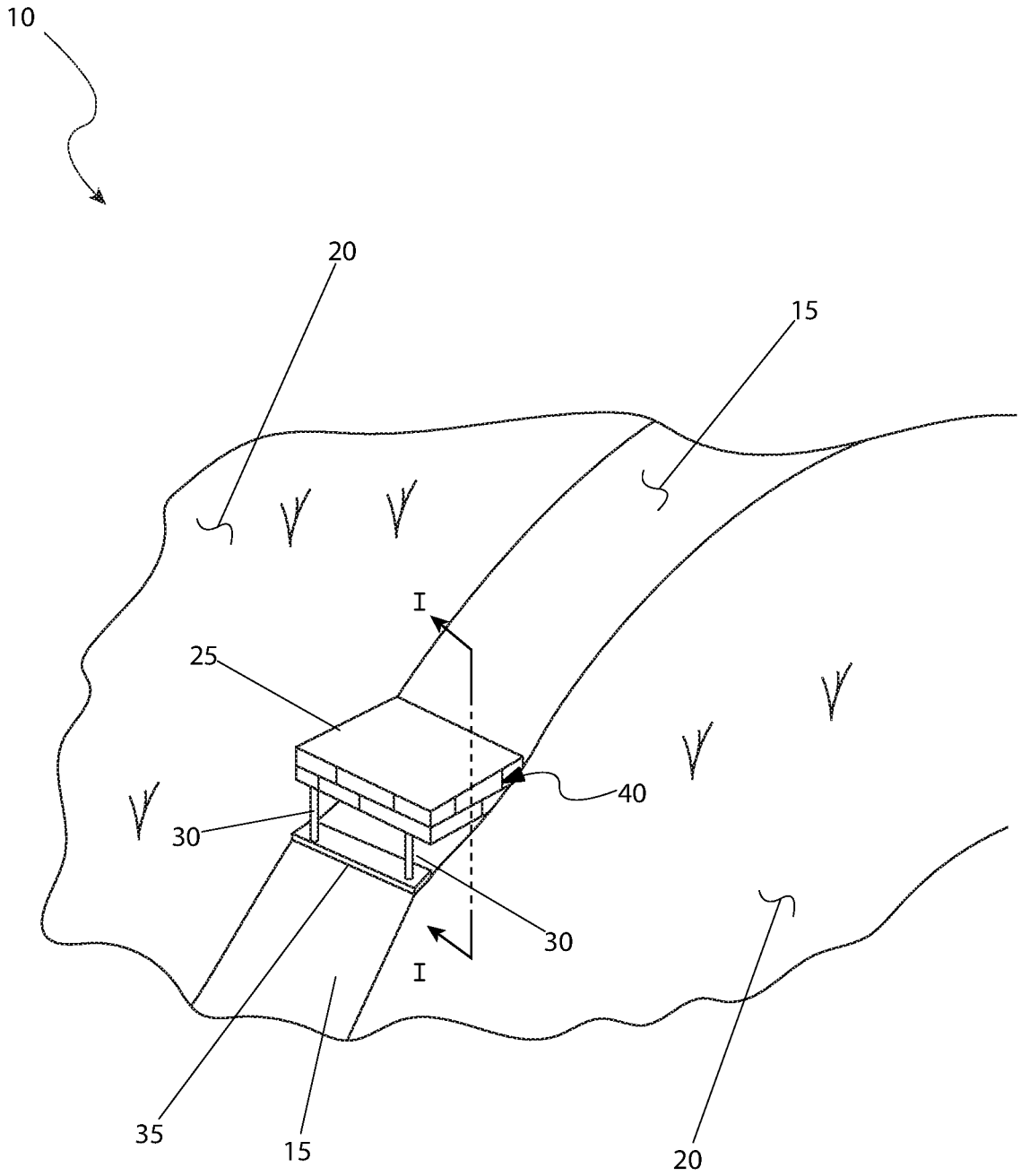
FIG. 1 is a perspective view of the landscaping step device 10, shown in a utilized state, according to the preferred embodiment of the present invention.

10 landscaping step device
15 outdoor pathway

20 inclining elevation
25 decorative step cover
30 long-threaded spike
35 ground plate
40 decorative outer finish
45 step plate
50 short-threaded spike
55 pointed end
60 stop nut
65 washer
70 grade adapter
75 top surface
80 bottom surface
85 incline angle "a"
90 angled gripping surface
95 oblong hole
100 first front edge
105 first threaded opening
110 second threaded opening
115 inlay grab connector
120 second front edge
125 recessed area
130 hook latch
135 reinforcing steel insert

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the landscaping step device 10, shown in a utilized state, according to the preferred embodiment of the present invention is disclosed. The landscaping step device 10 (herein also described as the "device") 10, is installed upon an outdoor pathway 15 in an inclining elevation 20. This device 10 provides a step or landing to aid a user in ascending or descending an outdoor pathway 15. While FIG. 1 depicts only one (1) device 10 for purposes of clarity, it is noted that additional units of the device 10 may be used for long outdoor pathway 15 as needed to allow for safe descent or ascent. Visible components of the device 10 include a decorative step cover 25, two (2) long-threaded spikes 30, and a ground plate 35. Additional components and their associated configuration will be provided hereinbelow. While overall dimensions of the device 10 will vary per specific use and model, it is envisioned that a typical size of the decorative step cover 25 would be approximately three feet (3 ft.) wide, two feet (2 ft.) deep, and six inches (6 in.) tall. Other dimensions of other components of the device 10 would vary as required. The use of any specific dimension of any component of the device 10 is not intended to be a limiting factor of the present invention.

Figure 2:
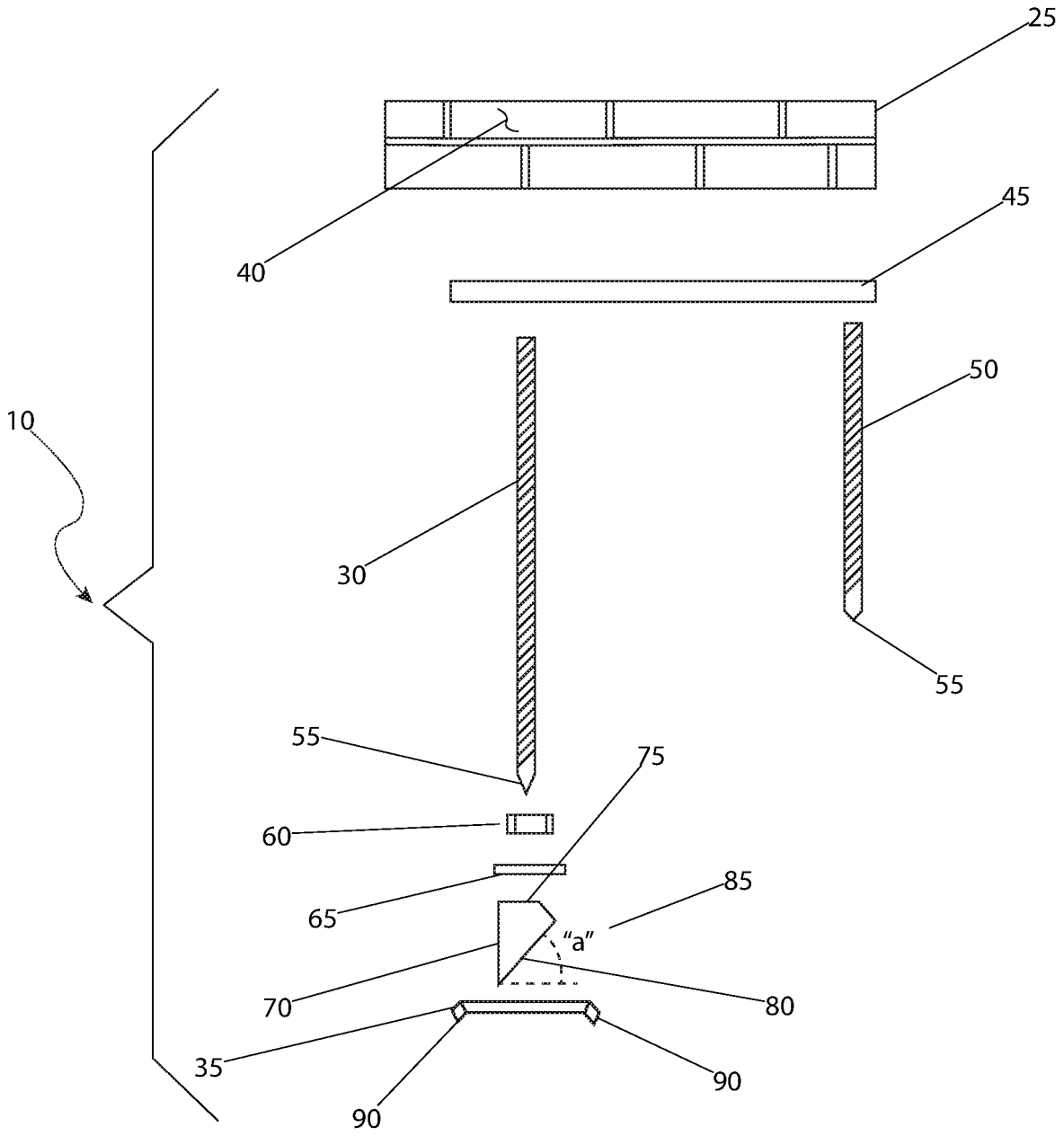
FIG. 2 is an exploded side view of the landscaping step device 10, as seen along a line I-I, as shown in FIG. 1, according to the preferred embodiment of the present invention.

Referring next to FIG. 2, an exploded side view of the device 10, as seen along a line I-I, as shown in FIG. 1, according to the preferred embodiment of the present invention is depicted. The uppermost component is the decorative step cover 25 here shown with a decorative outer finish 40 such as brickwork (shown), flagstone, wood planks or the like, depending on the user's personal preference. The use of any particular type of decorative outer finish 40 is not intended to be a limiting factor of the present invention. It is envisioned that the decorative step cover 25 would be made from polystyrene, fiberglass or other durable, weatherproof, lightweight material. This material would be reinforced with a metal core. Additional details on the interior construction of the decorative step cover 25 will be provided herein below.

Immediately below the decorative step cover 25 is a step plate 45. The step plate 45 interconnects the decorative step cover 25 to the two (2) long-threaded spikes 30 (of which only one (1) is shown due to illustrative limitations) and two (2) short-threaded spike 50 (of which only one (1) is shown due to illustrative limitations). The two (2) short-threaded spike 50 are fully embedded in the outdoor pathway 15 (as shown in FIG. 1). A pointed end 55 is provided to aid in insertion. The lower end of the two (2) long-threaded spikes 30 are each provided with a stop nut 60 to allow for adjustment of the device 10 to local grade conditions. The installing user would simply rotate the stop nut 60 on the long-threaded spike 30 until levelness of the step plate 45 is reached. A washer 65 then provides reinforcement. A grade adapter 70 is installed immediately below the washer 65. The grade adapter 70 is provided with a top surface 75 that is generally flat and level when in its final installed state. The grade adapter 70 is also provided with a bottom surface 80 that generally matches the grade angle of the inclining elevation 20 (as shown in FIG. 1). As such, an incline angle "a" 85 is produced. It is envisioned that multiple grade adapter 70 with varying incline angle "a" 85 (perhaps on a five-degree (5°) increments) would be provided with the device 10 or purchased as needed.

The ground plate 35 with two (2) angled gripping surfaces 90 is provided on the lower end of the long-threaded spike 30. It is envisioned that the step plate 45, the long-threaded spike 30, the short-threaded spike 50, the stop nut 60, the washer 65, the grade adapter 70, and the ground plate 35 would be made or steel with an anti-corrosion finish such as paint or plating to prevent corrosion. Stainless steel, fiberglass, plastic, or the like may also be considered as a material of construction. The specific materials of construction of the device 10 are not intended to be a limiting factor of the present invention.

Figure 3:
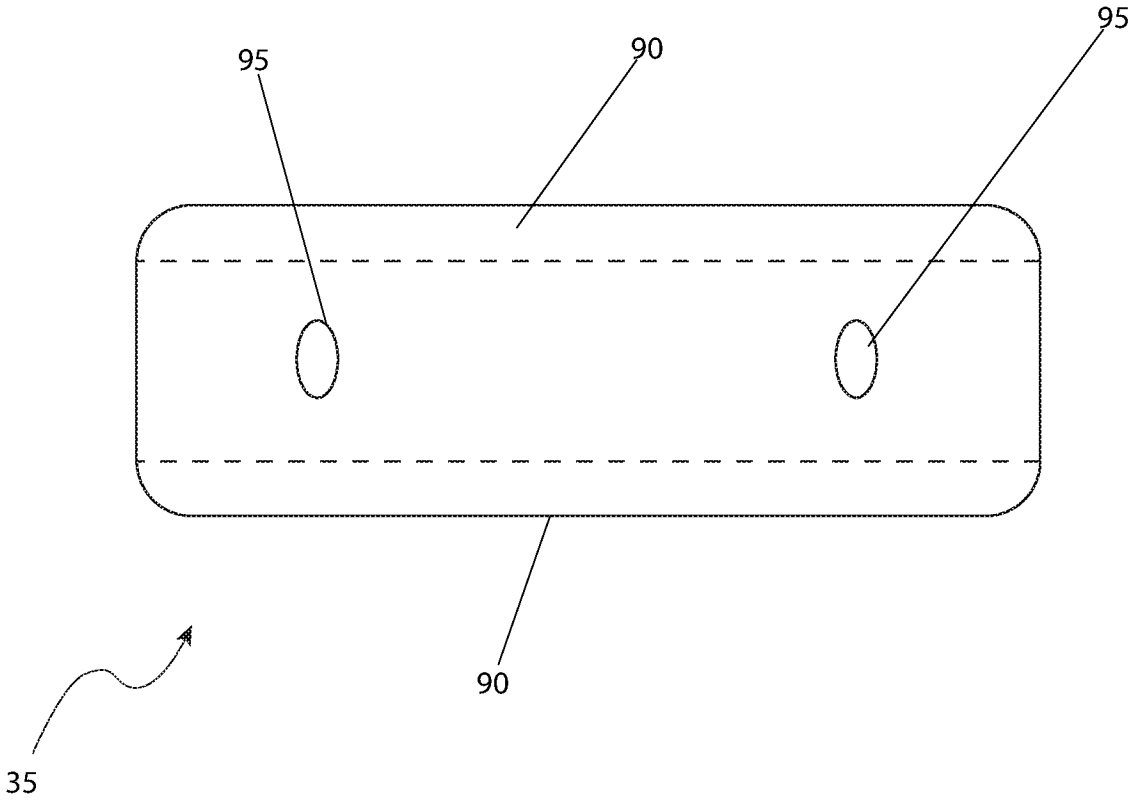
FIG. 3 is a top view of the ground plate 35, as used with the landscaping step device 10, according to the preferred embodiment of the present invention.

Referring now to FIG. 3, a top view of the ground plate 35, as used with the device 10, according to the preferred embodiment of the present invention is shown. The presence of the two (2) angled gripping surfaces 90 are shown and are identified as running along the entire length of both long edges of the ground plate 35. Two (2) oblong holes 95 are symmetrically located along the center axis of the ground plate 35 and accept the two (2) long-threaded spike 30 (as shown in FIG. 1 and FIG. 2). The shape of the oblong holes 95 accommodates the cylindrical profile of the long-threaded spike 30 when in an angled position as required by use of the grade adapter 70 (as shown in FIG. 2).

Figure 4:
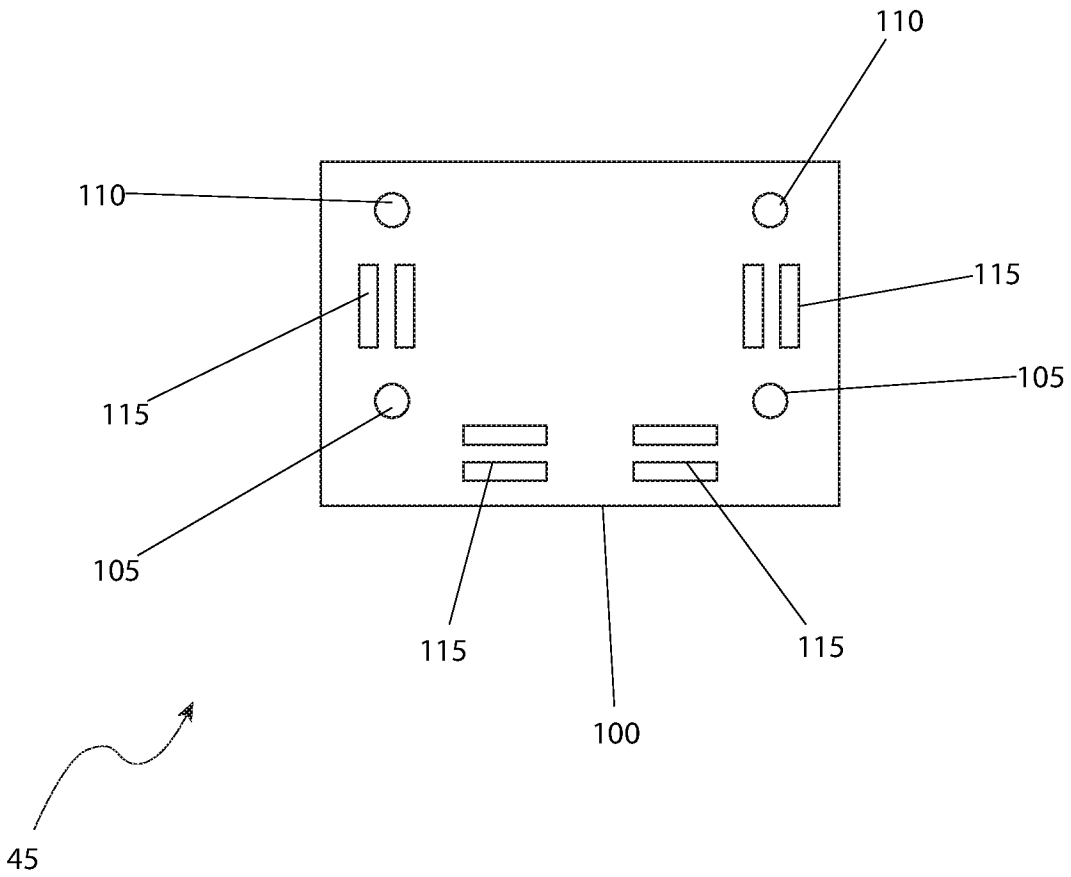
FIG. 4 is a bottom view of the step plate 45 as used with the landscaping step device 10, according to the preferred embodiment of the present invention.

Referring next to FIG. 4, a bottom view of the step plate 45 as used with the device 10, according to the preferred embodiment of the present invention is disclosed. The step plate 45 presents a first front edge 100 for purposes of reference. A set of two (2) first threaded openings 105 are provided near the first front edge 100 for connection of the upper end of the long-threaded spike 30 (as shown in FIG. 2). Likewise, a series of two (2) second threaded openings 110 are provided opposite the first front edge 100 for connection of the upper end of the short-threaded spike 50 (as shown in FIG. 2). A set of four (4) inlay grab connectors 115, envisioned to penetrate through the entire surface of the step plate 45 are provided for connection of the decorative step cover 25 (as shown in FIG. 1 and FIG. 2).

Figure 5:
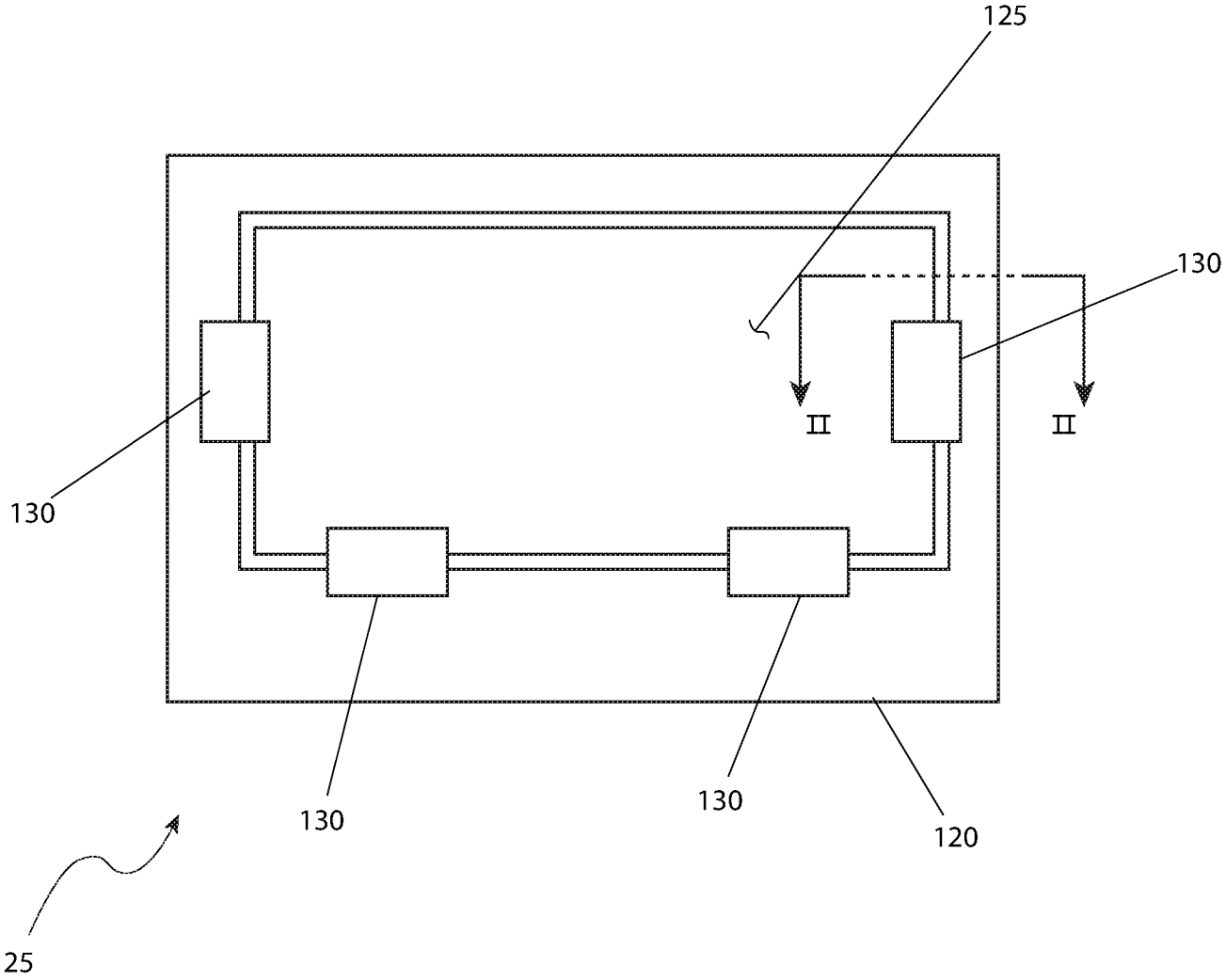
FIG. 5 is a bottom view of the decorative step cover 25 as used with the landscaping step device 10, according to the preferred embodiment of the present invention; and, FIG. 6 is a sectional view of the decorative step cover 25, as seen along a line II-II, as shown in FIG. 5, according to the preferred embodiment of the present invention.

Referring now to FIG. 5, a bottom view of the decorative step cover 25 as used with the device 10, according to the preferred embodiment of the present invention is depicted. The decorative step cover 25 presents a second front edge 120 for purposes of reference. A recessed area 125 is centrally and symmetrically located for the receiving of the step plate 45 (as shown in FIG. 2 and FIG. 4). The recessed nature of the recessed area 125 prohibits vision of the step plate 45 and presents an aesthetically pleasing view of the device 10 when approaching at an upward angle. A set of four (4) hook latches 130 are located along the associated side edges which engage the inlay grab connector 115 (as shown in FIG. 4). The engagement prevent uplift and ensure structural rigidity of the device 10. envisioned to penetrate through the entire surface of the step plate 45 are provided for connection of the decorative step cover 25 (as shown in FIG. 1 and FIG. 2).

Figure 6:
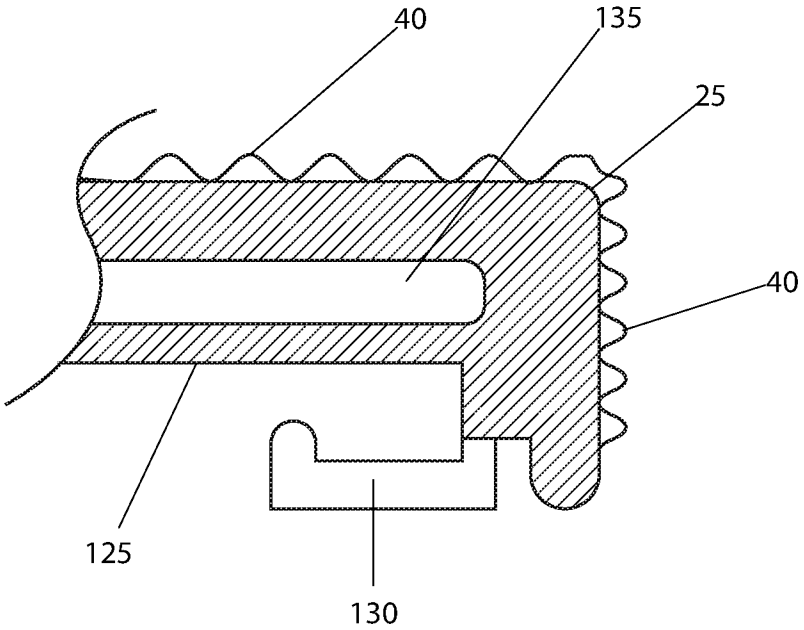

Referring to FIG. 6, a sectional view of the decorative step cover 25, as seen along a line II-II, as shown in FIG. 5, according to the preferred embodiment of the present invention is shown. This view discloses the clamping and securement arrangement provided by the hook latches 130. The recessed area 125 is hidden by the outer protruding face of the decorative step cover 25 which is covered with the decorative outer finish 40 on both the upper and side surfaces. A recessed area 125 is centrally located within the structure of the decorative step cover 25 to provide strength and rigidity.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 6. The user would procure the device 10 through normal procurement channels such as landscaping supply houses, home improvement stores, or similar establishments. Special attention would be paid to overall dimensions of the device 10, preferred decorative treatment afforded by the decorative outer finish 40, angle of installation to determine necessary incline angle "a" 85 provided by the grade adapter 70 and the like.

After procurement and prior to utilization, the landscaping step device for pathways 10 would be prepared in the following manner: the ground plate 35 and the short-threaded spike 50 would be threaded into the underside of the step plate 45 with the long-threaded spike 30 near the first front edge 100 and the short-threaded spike 50 away from the first front edge 100; the stop nuts 60 are threaded upon the long-threaded spike 30 near the approximate final position; the washers 65 are then installed; a grade adapter 70 with the appropriate incline angle "a" 85 is then installed over the long-threaded spike 30; the ground plate 35 is set into position; the device 10 is positioned in a desired position on an outdoor pathway 15 where excessive grade elevation changes occur with the long-threaded spike 30 at the lower elevation; both the long-threaded spike 30 and the short-threaded spike 50 is installed into the ground by hammering or other force until rear is nearly flush with grade and the ground plate 35 is flat and level; a final adjustment on the stop nuts 60 is performed such that the ground plate 35 is firmly contacting the outdoor pathway 15 and the grade adapter 70 are properly positioned; and the decorative step cover 25 is applied to the step plate 45 using the hook latches 130 and inlay grab connector 115 respectively.

During utilization of the device 10, the following procedure would be initiated: a user would walk along the outdoor pathway 15 as typically expected, during excessive grade changes, the user would step onto the device 10 and utilize it as a step allowing user to carefully step off the step to a lower elevation. Ascent would be accomplished in a similar but reversed manner.

Should the device 10 no longer be needed along a specific outdoor pathway 15, it may be removed by reversing the above process and reinstalled at another location.

Specific benefits afforded by use of the device 10 include but are not limited to: it is semi-permanent in nature; it may be used after use of the device 10, it may be used in flower and vegetable gardens along pathways, walkways, and the like; it is easily moved from season to season if desired; it is lightweight; it easily installed and moved by do-it-yourselfer; it is aesthetically pleasing to look at; it produces a non-slip flat and level surface; it is safe to walk on; it is easy to move to another location should future landscaping renovations occur; it provides for safe water drainage; and no digging is required for installation.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A landscaping step device, comprising:

a decorative step cover having a decorative outer finish;

a pair of long-threaded spikes each having a lower end, said lower ends are each provided with a stop nut to allow for adjustment of said landscaping step device to local grade conditions;

a ground plate having a pair of angled gripping surfaces, a first front edge, and a second front edge, each of said pair of angled gripping surfaces are provided on each said lower end of said long-threaded spike;

a pair of oblong holes symmetrically located along a center axis of said ground plate, said pair of oblong holes accept said pair of long-threaded spikes, said pair of oblong holes accommodates each said long-threaded spike when in an angled position as required by use of a grade adapter;

a set of a pair of first threaded openings provided near said first front edge for connection of an upper end of each said long-threaded spike;

a set of a pair of second threaded openings provided opposite said first front edge for connection of an upper end of a pair of short-threaded spikes;

a set of four inlay grab connectors penetrating through an entire surface of a step plate are provided for connection of said decorative step cover;

a recessed area centrally and symmetrically located for receiving said step plate, said recessed area prohibits vision of said step plate and presents an aesthetically pleasing view of said landscaping step device when approaching at an upward angle;

a set of four hook latches located along associated side edges which engage said four inlay grab connectors to prevent uplift and ensure structural rigidity of said landscaping step device to penetrate through said entire surface of said step plate to provide for connection of said decorative step cover; and wherein said step plate is below said decorative step cover and, wherein said step plate interconnects said decorative step cover to said pair of long-threaded spikes and said pair of short-threaded spikes.

2. The landscaping step device according to claim 1, wherein said decorative step cover is made of material selected from the group consisting of polystyrene, fiberglass, or durable, weatherproof, lightweight material reinforced with a metal core.

3. The landscaping step device according to claim 1, wherein said decorative step cover is three feet wide, two feet deep, and six inches tall.

4. The landscaping step device according to claim 1, wherein said decorative outer finish is selected from the group consisting of brickwork, flagstone, or wood planks.

5. The landscaping step device according to claim 1, wherein each said stop nut is rotated on each said long-threaded spike until a desired level of said step plate is reached.

6. The landscaping step device according to claim 5, further comprising a washer to provide reinforcement to each said stop nut.

7. The landscaping step device according to claim 6, wherein said grade adapter is installed immediately below said washer.

8. The landscaping step device according to claim 7, wherein said grade adapter includes a top surface that is generally flat and level when in its final installed state.

9. The landscaping step device according to claim 7, wherein said grade adapter includes a bottom surface that generally matches a grade angle of an inclining elevation producing an incline angle.

10. The landscaping step device according to claim 9, wherein said grade adapter produces said incline angle in five-degree increments with said landscaping step device.

11. The landscaping step device according to claim 1, wherein said pair of angled gripping surfaces run along an entire length of both said edges of said ground plate.

12. The landscaping step device according to claim 1, wherein said recessed area is hidden by an outer protruding face of said decorative step cover which is covered with said decorative outer finish on both an upper surface and a side surface.

13. The landscaping step device according to claim 1, wherein said recessed area is centrally located within said decorative step cover to provide strength and rigidity.

14. The landscaping step device according to claim 1, wherein each said pair of short-threaded spikes include a pointed end to aid in insertion.

15. The landscaping step device according to claim 1, wherein said step plate, said pair of long-threaded spike, said pair of short-threaded spike, each said stop nut, said washer, said grade adapter, and said ground plate are made of steel with an anti-corrosion finish.

16. The landscaping step device according to claim 15, wherein said anti-corrosion finish is paint.

17. The landscaping step device according to claim 15, wherein said anti-corrosion finish is plated to prevent corrosion.

18. The landscaping step device according to claim 1, wherein said step plate is made of material selected from the group of stainless steel, fiberglass, or plastic.

19. The landscaping step device according to claim 1, wherein said landscaping step device provides a step to aid in ascending on an outdoor pathway.

20. The landscaping step device according to claim 19, wherein said landscaping step device provides a step to aid in descending on said outdoor pathway.

* * * * *